US006041444A

United States Patent [19]

McKinney

[11] Patent Number: 6,041,444

[45] Date of Patent: Mar. 28, 2000

[54] COMPONENT LOAD SUPPORTING ARTICULATED WAIST BELT

[76] Inventor: John McKinney, P.O. Box 96, Coram, Mont. 59913

[21] Appl. No.: 08/995,634

[22] Filed: Dec. 22, 1997

[51] Int. Cl.[7] ..... A45F 5/00

[52] U.S. Cl. ..... 2/310; 2/338; 2/312; 2/317; 224/197; 224/271; 224/272; 224/904

[58] Field of Search ..... 2/310, 311, 312, 2/314, 315, 317, 319, 320, 336, 338; 224/197, 271, 272, 904, 151 R; 182/3, 4; 119/857

[56] References Cited

U.S. PATENT DOCUMENTS

| | | | |
|---|---|---|---|
| 337,194 | 3/1886 | Poteet | 224/216 |
| 892,991 | 7/1908 | Hepworth | 224/259 |
| 1,207,154 | 12/1916 | Fox | 224/260 |
| 1,601,624 | 9/1926 | Houghton | 224/195 |
| 1,723,147 | 8/1929 | Fourethier . | |
| 3,191,828 | 6/1965 | Senne . | |
| 3,664,560 | 5/1972 | Perkins | 224/5 R |
| 4,114,788 | 9/1978 | Zufich . | |
| 4,189,076 | 2/1980 | Zufich . | |
| 4,303,186 | 12/1981 | Ollinger, IV . | |
| 4,372,468 | 2/1983 | Harvey . | |
| 4,600,134 | 7/1986 | Colby . | |
| 4,747,527 | 5/1988 | Trumpower, II . | |
| 4,923,105 | 5/1990 | Synder . | |
| 4,962,873 | 10/1990 | Schattel . | |
| 5,064,108 | 11/1991 | Headley . | |
| 5,067,643 | 11/1991 | McKinney | 224/197 |
| 5,106,082 | 4/1992 | Moschetti et al. . | |
| 5,160,073 | 11/1992 | Bateman . | |
| 5,163,591 | 11/1992 | Leiserson et al. . | |
| 5,170,918 | 12/1992 | Perron . | |
| 5,183,194 | 2/1993 | Shirdavani . | |
| 5,193,725 | 3/1993 | Radocy . | |
| 5,265,781 | 11/1993 | Nichols | 224/198 |
| 5,329,884 | 7/1994 | Bell | 119/857 |
| 5,341,974 | 8/1994 | Robinson et al. . | |
| 5,341,975 | 8/1994 | Marinescu . | |
| 5,413,262 | 5/1995 | Dewire et al. . | |
| 5,477,997 | 12/1995 | Weatherly . | |
| 5,489,051 | 2/1996 | Robinson . | |
| 5,497,923 | 3/1996 | Pearson et al. | 224/253 |
| 5,553,759 | 9/1996 | McMaster et al. . | |
| 5,564,612 | 10/1996 | Gregory . | |

*Primary Examiner*—John J. Calvert
*Assistant Examiner*—Tejash Patel
*Attorney, Agent, or Firm*—Dowrey & Associates

[57] ABSTRACT

A load supporting waist belt comprising four separate articulated sections including front and rear belt straps and right and left hip pieces with adjustable connectors on the front and rear belt straps allowing adjustment for waist size and location of hip sections squarely on the wearer's hips. The hip pieces are stiff members capable of supporting tool hangers, pouches and the like and are provided with accompanying hip pads for contacting the wearer's hips. Brackets are used to lower the load attachment points to a position below the waist and in the area of the connection of the thigh bone to the hip of the wearer. A slide bar release mechanism is disclosed for detachably connecting loads to the support pivots. A shoulder harness is connected at pivotal anchor points on each hip section.

8 Claims, 8 Drawing Sheets

61
33
21
23
32
26
7
16
17
18
28
29
4
5
32b
63
64
12
32a
11
8
3
34
51
52
49
47
48

FIG. 11
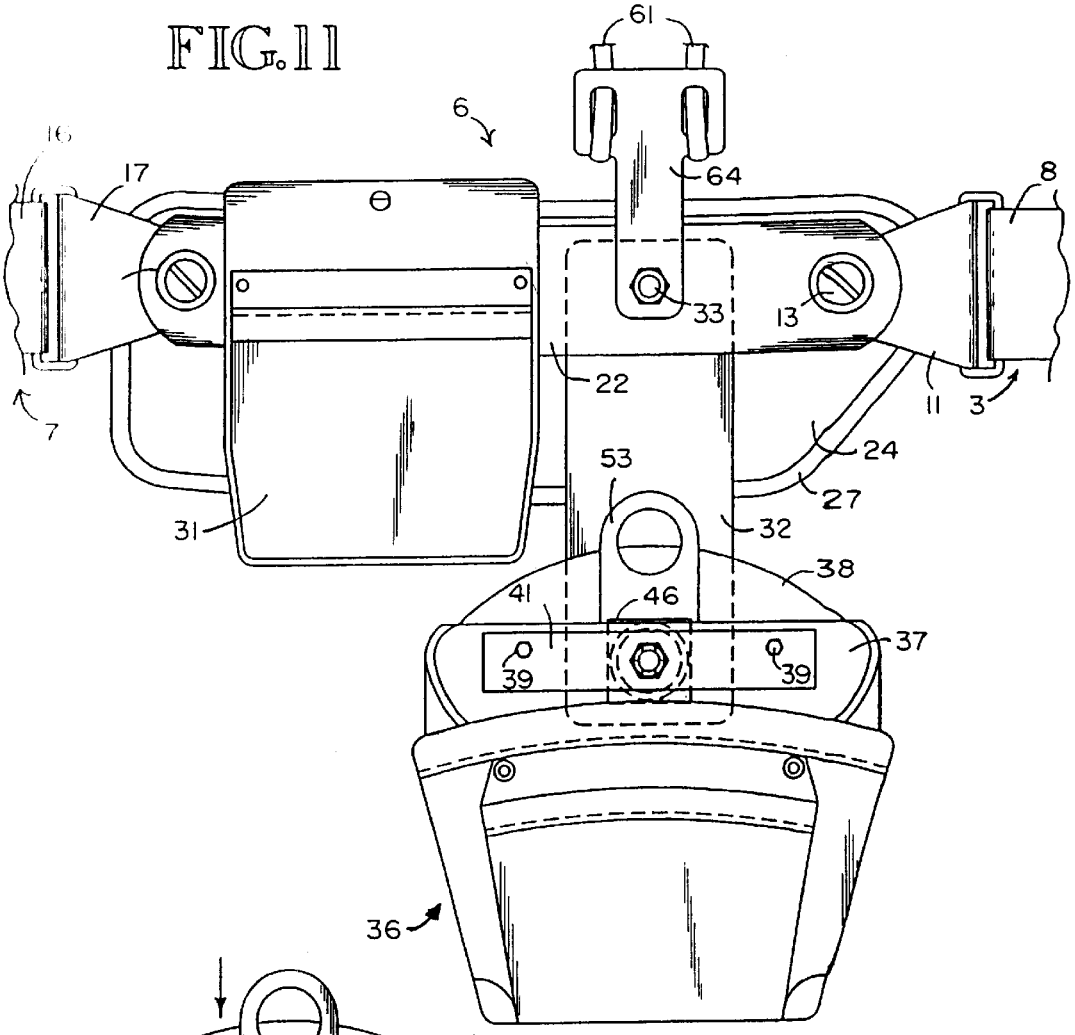
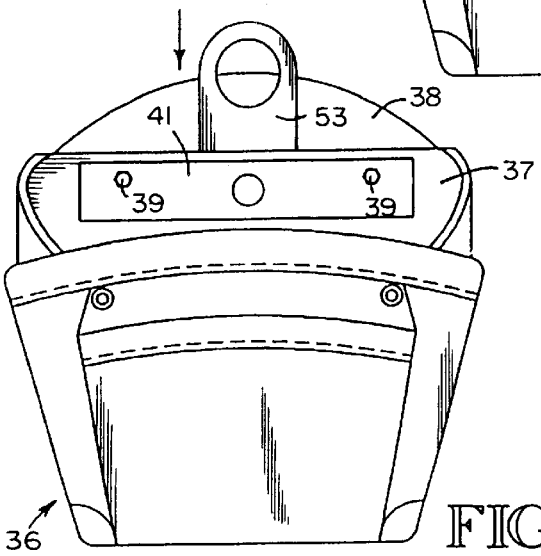
FIG. 12
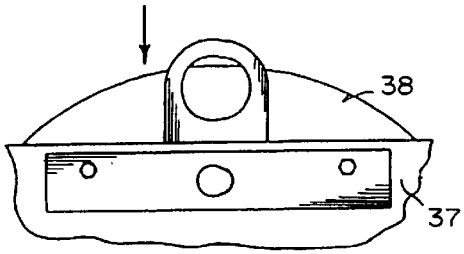
FIG. 13

FIG. 23
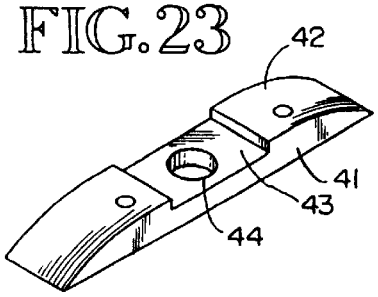
FIG. 16
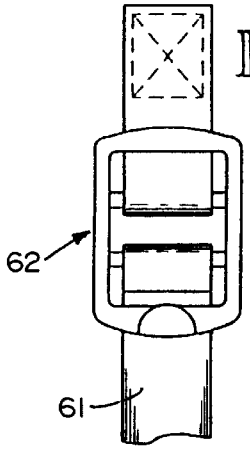
FIG. 15
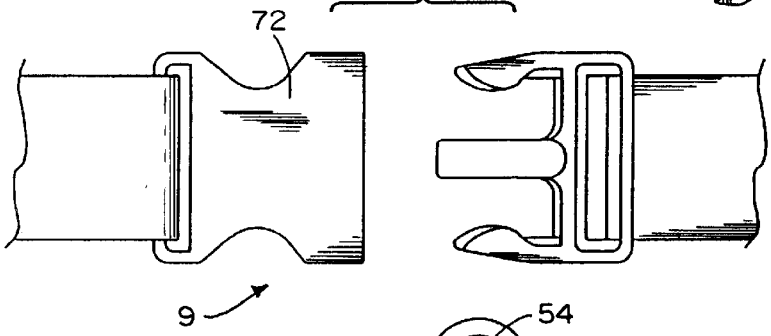
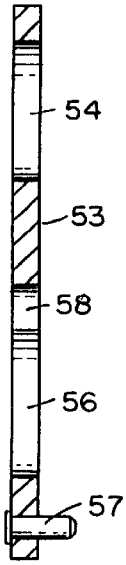
FIG. 24
FIG. 27
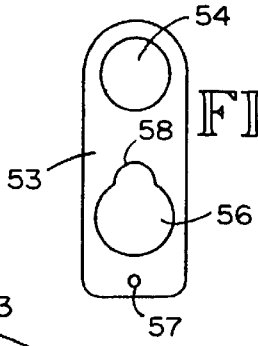
FIG. 25
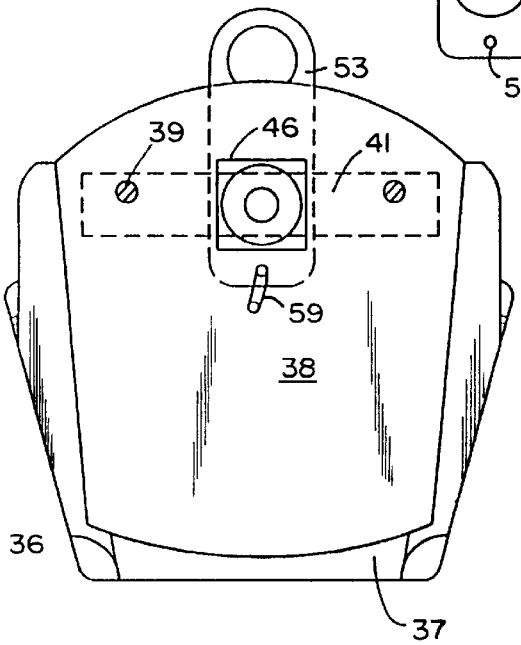
FIG. 26
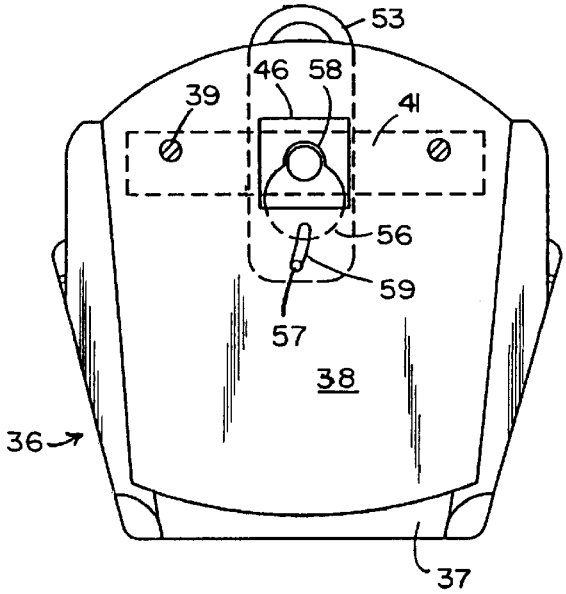

COMPONENT LOAD SUPPORTING ARTICULATED WAIST BELT

BACKGROUND OF THE INVENTION

1. Field of the Invention

The present invention relates to load supporting belts such as used by artisans in the building trades, in-field workers or for general utility support purposes. More particularly, the invention relates to such a load supporting belt which is segmented and articulated for engaging the contours of the wearer's hips and supporting a load below the waist at the approximate hip-thigh joint.

2. Prior Art

In general, load supporting belts, both with and without supporting shoulder straps, are well known in the prior art. Such belts are used for a variety of purposes such as tool supports for artisans and mechanics in the construction trades and for more specialized purposes, as for example, carrying planting supplies in the field or forest or supporting certain categories of sports equipment. One of the primary problems with such load supporting belts is that of adapting the belt for use by persons of varying waist sizes and hip contours. The belt itself is usually secured about the wearer's waist with primary vertical support being relied upon through contact with the wearer's hips. For this reason it is usually necessary to manufacture and stock such load supporting belts in a variety of graded mens and womens sizes in an attempt to match the belt with both waist size but body contour. As a result, the desired 100% hip contact with the belt surface is seldom achieved.

The belts of the type under consideration usually place the load attachment point on the belt at waist level. My prior U.S. Pat. No. 5,067,643 discloses a load supporting belt and shoulder harness of the type described wherein the load supporting pouches are pivotally connected to the waist belt. In this embodiment, the carrying pouches are allowed to swing freely which maintains the load substantially stationary while the wearer bends and moves about to perform physical tasks. As with other prior art devices, the belt itself is a single continuous unit with a front buckle. In addition to the difficulty of initially obtaining an exact fit for the particular user as discussed, the single piece belt loses its ability to perform its intended function as the physically active wearer moves about. For instance, as the field person bends and walks or uses chopping or digging tools, the belt shifts and loses its ability to support the load from the wearer's hips.

SUMMARY OF THE INVENTION

A load supporting waist belt is provided which has essentially four sections, all of which are articulated relative to one another allowing belt-attached hip pads to make 100% contact with the wearer's hips and to be adjustable to all sizes and body types. The belt includes front and rear adjustable straps and pivotally connected intermediate hip pieces. Flexiable contoured hip pieces including appropriate hip padding are connected to the ends of the front and rear straps for comfortably engaging and transferring load to the wearer's hips. The hip pieces contour or flex to conform or curve around the wearer's hips for proper fit and comfort. Additionally, hip straps may be provided that overlay the hip pieces and are pivotally connected to the front and rear straps, thereby providing load connection points for such items as tool holders, tool pouches and/or pivot brackets while the hip pads or pieces remain adjustably positioned on the wearer's hips. A downwardly extending rigid bracket may be connected to the hip piece of the waist belt to provide a connection point for pivotally supporting a tool pouch or the like. Ideally the pouch is mounted for relatively free-swinging motion below the waist level and in the area of the wearer's thigh and hip bone connection. The tool pouch engages a pivot post on the bottom of the support bracket with a slide lock mechanism being engagable to temporarily retain the tool pouch on the pivot post. When a quick release of a pouch is desired, the slide lock may be quickly withdrawn and the tool pouch quickly disengaged from its pivotal connection. A bolt and lock nut fasterner will suffice where quick release is not desired.

Support straps are connected to a single connecting point on each hip and extend over the wearer's shoulders to provide added support for the waist belt. For waist size adjustment and hip piece alignment, the rear belt strap includes a length adjuster and the front belt strap includes a length adjustor and a releasable buckle.

BRIEF DESCRIPTION OF THE DRAWINGS

FIG. 11 is a side elevational view of the right hip section of the waist belt with tool pouch in place prior to locking;

FIG. 12 is a front elevational view of the tool pouch with the slide lock disengaged;

FIG. 13 is an elevational detail showing the position of the slide lock in the engaged position;

FIG. 15 is an exploded detail of the releasable buckle on the pectoral strap circled in FIG. 14;

FIG. 16 is an elevational detail showing the strap adjuster for the shoulder harness circled in FIG. 14;

FIG. 23 is a perspective of the tool pouch stiffener bar;

FIG. 24 is a cross sectional view taken along lines 24—24 of FIG. 22;

FIG. 25 is a rear elevational view taken along lines 25—25 of FIG. 22 showing the slide lock in the disengaged position;

FIG. 26 is a rear elevational view similar to FIG. 25 with the slide lock in the engaged position; and FIG. 27 is an elevational view of the slide lock bar.

DESCRIPTION OF THE PREFERRED EMBODIMENT

Figure 14:
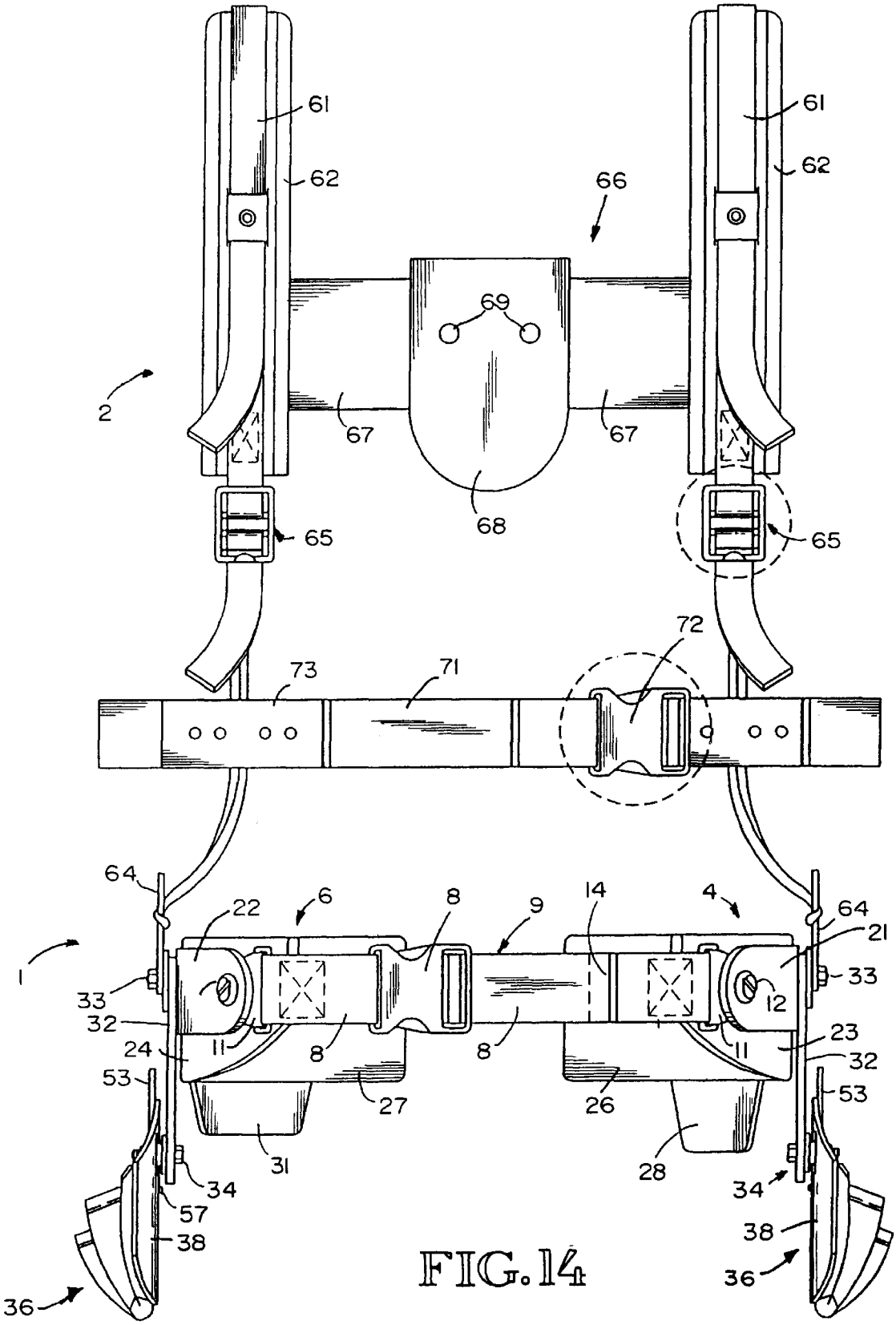
FIG. 14 is a front elevational view of the articulated waist belt connected to the shoulder harness.

The load supporting belt of the present invention is essentially a four section articulated belt with a releasable front buckle with each section having a unique function. The support belt and auxiliary shoulder harness are shown in the assembled form in FIGS. 14 and 17. Referring to these figures, the articulated belt is indicated generally by the numeral 1 and the shoulder harness is indicated generally at 2. The four sections of the belt comprise the front section 3, the left hip section 4, the right hip section 6 and the rear section 7. The front and rear belt sections 3 and 7 are similar in structure and comprise standard webbing, or other flexible material, of the appropriate strength and dimensions to suit for the particular use to which the belt is intended. The front section 3 as shown in FIG. 14 comprises the two strap sections 8 joined by the releasable connector 9 which may be a well known snap lock connector such as shown in FIG. 15. In the alternative any standard form of belt buckle or releasable connector may be used. The front strap sections 8 are each provided with articulated rigid end connectors 11 pivotally connected as at 12 and 13 to the left and right hip sections respectively. The end connectors 11 may be formed from metal or hard plastic material and connected to the associated webbing with standard wire metal clips as illustrated. The front section 3 will also be provided with a conventional length adjuster, either as indicated at 14 or as a part of the releasable connector 9.

Figures 1, 2, 3:
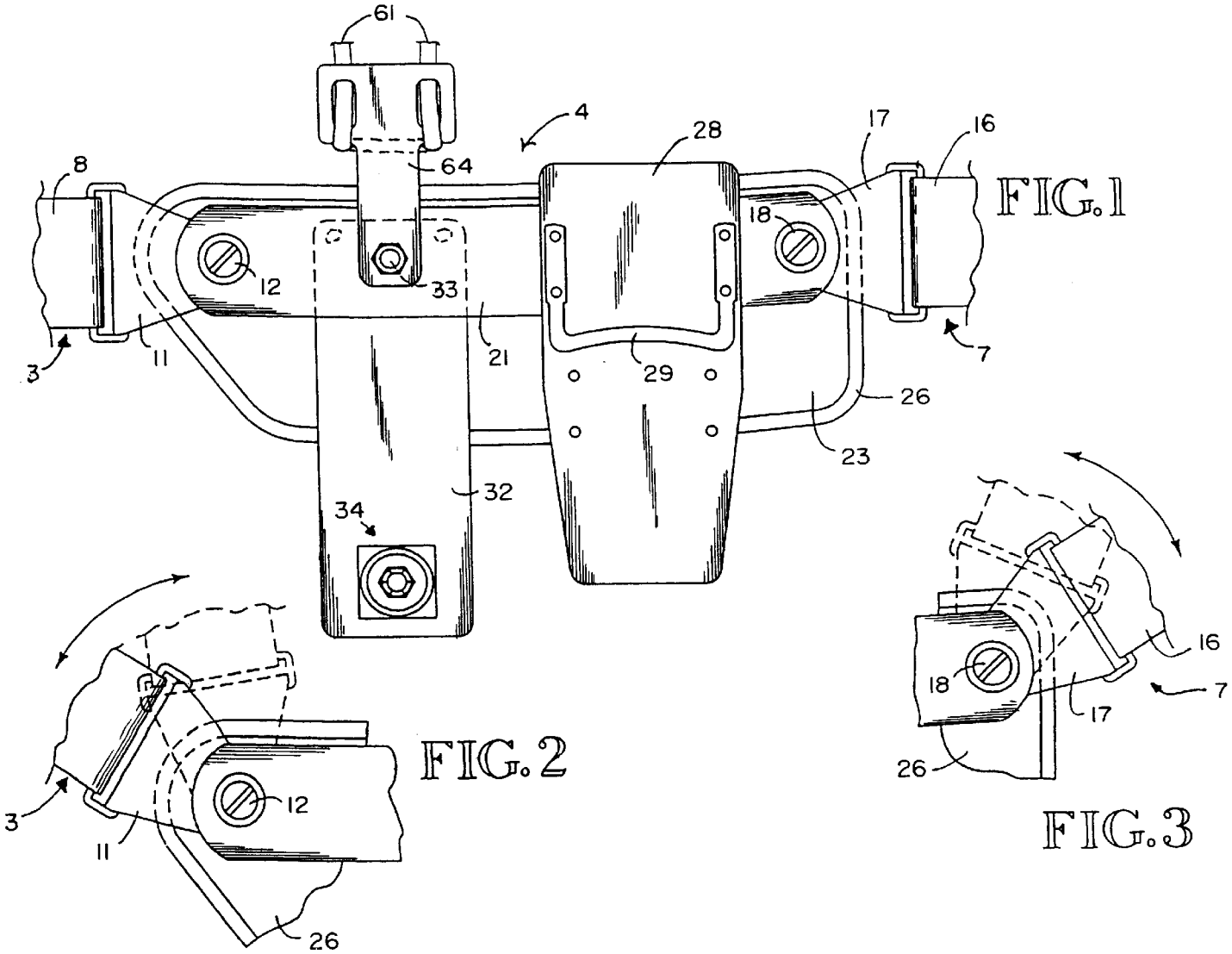
FIG. 1 is a side elevational view of the left hip section of the waist belt.
FIG. 2 is an elevational detail illustrating the pivotal connection between the hip section of FIG. 1 and the front belt strap.
FIG. 3 is an elevational detail illustrating the pivotal connection between the hip section and the rear belt strap.

The rear belt section 7 may be constructed from standard webbing of the front sections 16 identical to the webbing 8 and will be provided with rigid end connectors 17 in the same manner as described for the connectors 11 for the front strap. Alternately, the rear belt section 7 may be constructed from plastic that does not require the use of end connectors 17. The connectors 17 are pivotally joined to the left and right hip sections by the pivot pins 18 and 19 respectively. The rear strap section 16 will also be provided with a conventional length adjuster (not shown), either along its length or in conjunction with the hinged connections to the end connectors 17. FIG. 3 illustrates the pivotal movement between the end connectors of the front and rear straps and the hip sections.

Figure 8:
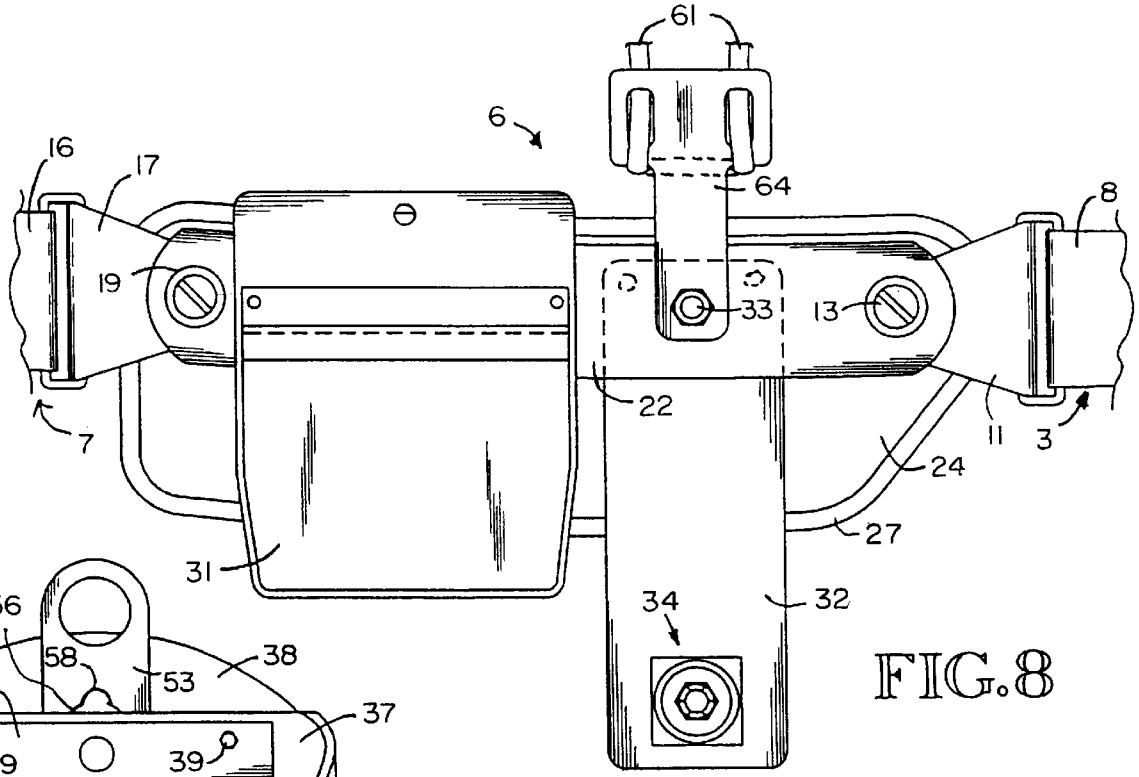
FIG. 8 is a side elevational view of the right hip section of the waist belt.
Figure 9:
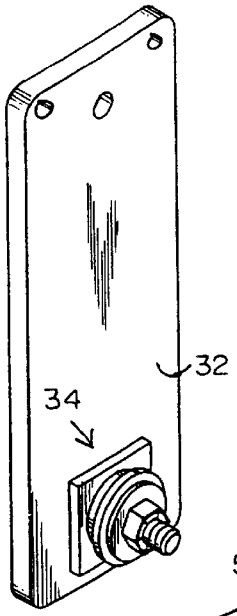
FIG. 9 is a perspective view of the tool pouch bracket.
Figure 10:
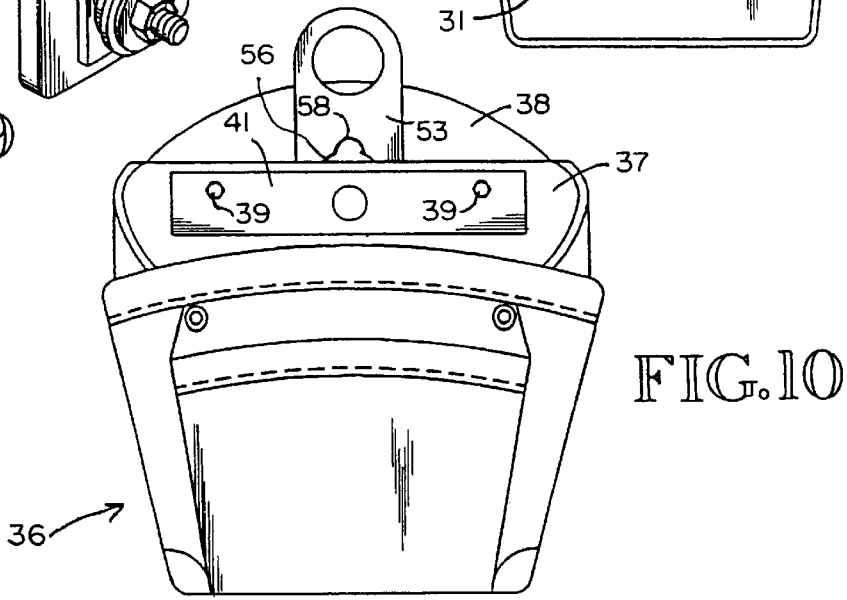
FIG. 10 is a front elevational view of the tool pouch.

Referring to FIGS. 1 and 8, the left hip section 4 includes a hip strap 21 and the right hip section 6 includes a hip strap 22. Hip straps 21 and 22 are not essential but they provide a convenient means for attaching tool pouches and the like to the belt. Moreover, the hip straps may be engineered to safety belt standards, along with the front and rear straps, when desired. For agricultural use, the hip straps may be neither necessary nor desired. The right and left hip straps and hip pieces are pivotally connected at their opposite ends to the respective end connectors 11 and 17 of the front and rear straps respectively. With this arrangement it may be seen that the waist belt when connected by the buckle 9 is a four part articulated belt which may be adjusted to fit any particular waist size. The hip straps 21 and 22 in the preferred embodiment are constructed from relatively stiff plastic, capable of supporting loads without bending while being sufficiently flexible to conform to the curvature of the hip pads or hip pieces as will be presently described. The pivotal connections at 12 and 13 may be conveniently provided by T-nut and screw fasteners. The T-Nuts have a shank length sufficient to extend through the respective hip piece, through the rear or front strap with or without a pivotable connector, and through the hip strap if provided, so that the screw will secure the components together without binding, thereby enabling the necessary pivotal movement.

Left and right hip pieces 23 and 24 extend coextensively with the hip straps 21 and 22 between the pivots 12, 18, and 13, 19 respectively but are connected to the pivot points separately from the hip straps. As may be seen from FIGS. 1 and 8, the hip pieces 23 and 24 are significantly wider than the associated hip straps for the purpose of providing a more substantial contact surface with the wearer's hips. The forward ends of the hip pieces are preferably inclined near the pivotal connection with the front strap to avoid any possible contact with the wearer's legs in the bending or squatting position. The hip pieces 23 and 24 are also formed from relatively rigid plastic and, as viewed in FIG. 14, flex or are curved so as to approximate the average hip curvature when installed with hip straps, the hip straps causing formation of the hip piece curvature. To complete the hip piece, cloth or plastic covered cushioning layers 26 and 27 are fixed to the inside surface of the hip pieces 23 and 24 respectively. The cushioned layers 26 and 27 may be made from any suitable material such as foamed rubber or plastic or other cushioning material and may be adhered to the inside surface of the hip pieces by such means as independent rivets, adhesives or other means including the pivot bolts 12, 13, 18 and 19. The belt is thus not only adjustable for waist size but, by adjusting the front and rear belt straps, the two hip pieces 23 and 24 may be independently positioned for full engagement with the particular wearer's hips. As the wearer bends or twists the hip pieces can remain aligned with the wearer's hips with the front and back straps remaining in position across the wearer's front and back parts of the waist.

As aforementioned, the stiff plastic hip straps 21 and 22 are designed to provide attaching points for various tools and/or carrying pouches and the like, some of which may be interchangeable between the right and left hip straps. For instance, the tool hanger attachment 28 shown mounted on the hip strap 21 may be made of heavy canvas or plastic with the upper end having a pass-through for hanging the item on the strap. The attachment includes a metal hanger bar 29 for holding such tools as hammers, hatchets and the like. Another type of carrying device adapted for mounting on the hip strap is the pouch or pocket 31 for holding loose items such as nails or other supplies. Like the tool hanger 28, the pouch 31 may be of any known design and may simply hang on the hip strap 22 in a well known manner. These devices are illustrated as a matter of example and it will be understood that any number of types of carrying devices or pouches may be connected directly to the hip strap in whatever order desired by the wearer. Moreover, the provision of hip straps may be used to keep the standard hip pieces from being the weak links in the belt.

Figures 4, 5, 6, 7:
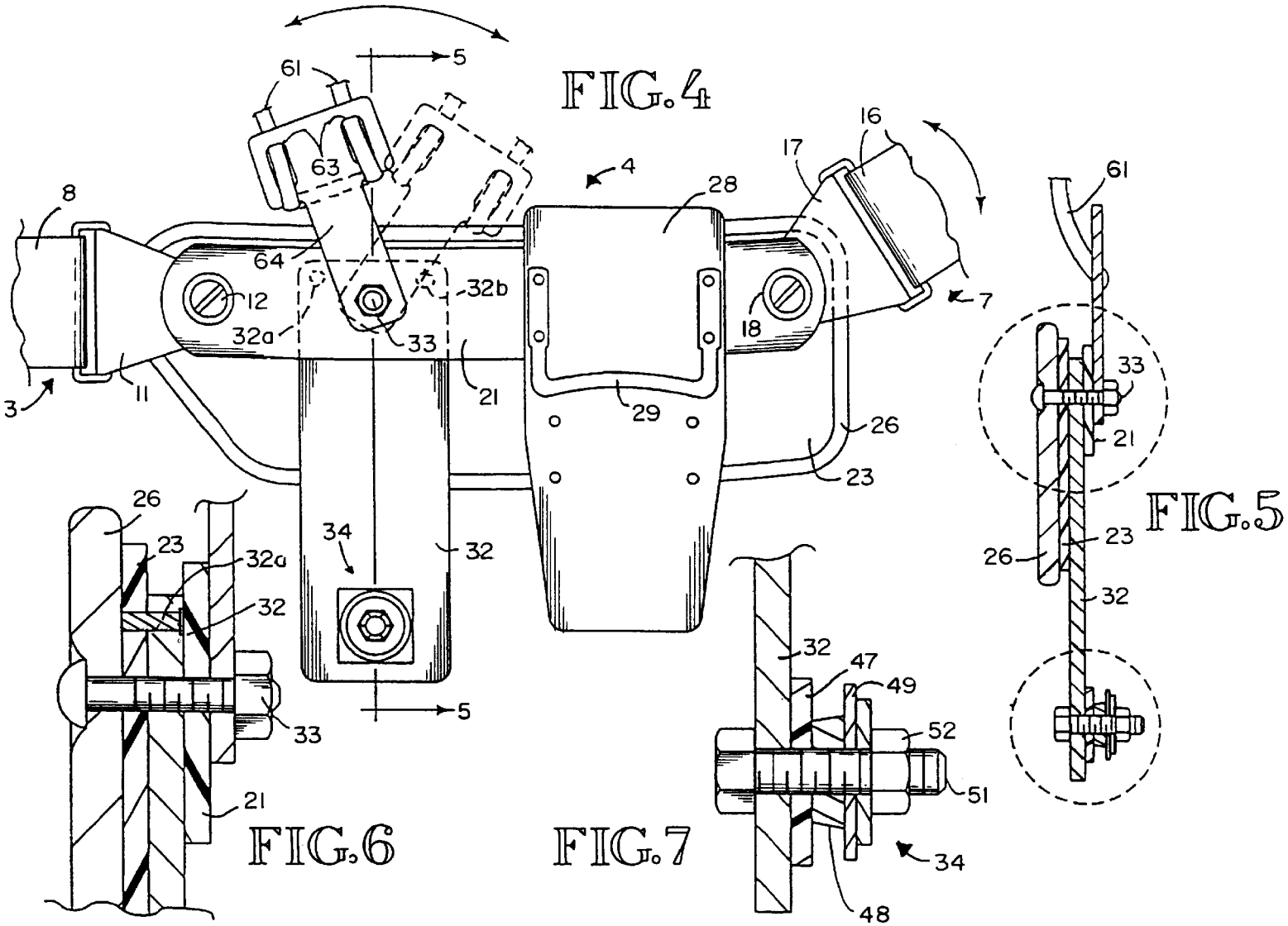
FIG. 4 is a side elevational view of the left hip section illustrating the shoulder strap connection.
FIG. 5 is a cross sectional view taken along lines 5—5 of FIG. 4.
FIG. 6 is an enlarged detail of the belt and bracket connection circled in FIG. 5.
FIG. 7 is an enlarged detail of the tool pouch pivotal connection circled in FIG. 5.

Since it may be desired to suspend heavier loads from the belt and yet to allow the load to be pivotally connected to swing freely, it is advantageous to pivotally connect the load at a point below the waist level. As seen most clearly in FIG. 4, this may be accomplished by connecting a substantially vertical bracket 32 to the hip section. As shown specifically in FIGS. 4 and 6, the bracket 32 is riveted to the hip piece at two points at 32*a* and 32*b*. As shown in FIGS. 4–6 the bracket is connected to both the hip strap 21 and the hip piece and will be held tightly against rotation by means of the riveted connection. The bracket 32 may be made from any lightweight material such as heavy gauge aluminum capable of supporting the intended load without bending. As shown in FIGS. 8 and 11, the right hip section 6 may be provided with an identical load bracket 32 attached as described. The bracket 32 will be of sufficient length to place a load attachment post assembly 34 in the area of the wearer's hip-thigh bone connection. This area may be described as the articulating point where the thigh bone muscles connect to the hip. Although the bracket 32 is illustrated as being planer or straight, it will be understood that if desired, the bracket may be bent inwardly adjacent its bottom end to accommodate the slightly inward tilting of the hip sections when in place on the wearer's hips. The load bracket 32 in the present embodiment is designed to support a workman's tool pouch indicated generally at 36 in the drawings which may be of any conventional design usually including several individual compartments for supporting a substantial weight in tools and/or supplies. It will be understood, of course, that the type of load supported by the attachment posts 34 is not limited and may be any load capable of being sustained by the support belt.

The tool pouch 36 may take any one of a number of forms and is usually made from heavy canvas duck or the like material with various leather trims and reinforcements. For purpose of the present description, the pouch will include a back wall of canvas material indicated at 37 in the drawings. According to the present invention, the pouch structure and the pivot post assembly 34 are specially constructed to provide a quick release slide lock enabling the user to rapidly unlock and detach the pouch when necessary. Referring to the pouch assembly, a stiff backboard 38 is connected to the top edge of the back wall of the pouch by means of the bolts 39 and the stiffener 41 with bolts 39 extending completely through the stiffener and the back board to hold it securely in place. The back board may be made from heavy stiff plastic or the like and will be preferably curved to enhance rigidity and its cooperation with the tool pouch. The stiffener 41 may be made from any suitable material such as wood, metal or plastic and will include a curved face 42 for mating with the curvature of the back board and a recessed central area 43. A bore 44 extends through the central portion of the stiffener and communicates with an opening in the back wall 37 of the pouch. The back board has an enlarged opening 46 which also communicates with the openings in the stiffener 43 and the pouch wall.

Referring to FIG. 7, the pivot post assembly 34 includes a backing washer 47, a spacer 48 and a washer assembly 49 mounted on the bolt 51 and clamped to the bottom end of the bracket 32 by means of the nut 52. The mounting bolt assembly is sized so as to pass freely into the openings in the back board 38, pouch wall and opening 44 in the stiffener 41. A lock slide bar 53 shown in FIG. 27 includes a circular cut-out 54 in its upper end to facilitate a finger grip, an enlarged circular opening 56 in its lower end and a pin member 57 protruding from the bottom end of its rear face. It will also be noted that the circular opening 56 is provided with a semi-circular extension 58 for a purpose to be described. The lock slide bar 53 is received between the back board 38 and the back wall 37 of the pouch and positioned to be guided by the recessed or slotted area 43 of the stiffener 41. When located in operating position, the pin 57 on the back face of the lock slide bar extends through and is guided by a suitable slot 59 in the back board as shown in FIGS. 25 and 26. With this arrangement the lock slide bar 53 may be moved from the raised or released position shown in FIGS. 12 and 25 to the lowered or locked position shown in FIG. 26 guided by the pin and slot arrangement and the recessed area of the stiffener 41. As may be best understood from reference to FIGS. 19–21 to 25–27, when the pouch and back board are moved against the bracket 32, the entire pivot post assembly enters the openings in the back board and stiffener bar with the backing washer 47 entering the opening 46 of the back board allowing the back board to be moved into contact with the bracket 32. In this position, when the slide lock bar 53 is slid downwardly, the semi-circular extension 58 on the opening 56 permits the slide bar to pass between the washers 47 and 49, locking the tool pouch on the pivot post. Since the back board is not clamped against the bracket 32 and the washer 47 is freely rotatable on the bolt 51, the tool pouch is thus free to swing about the pivot post. When it is desired to remove the tool pouch, the slide bar 53 is raised by finger pressure in the opening 54 and the back board is allowed to disengage the pivot post.

Figures 17, 18:
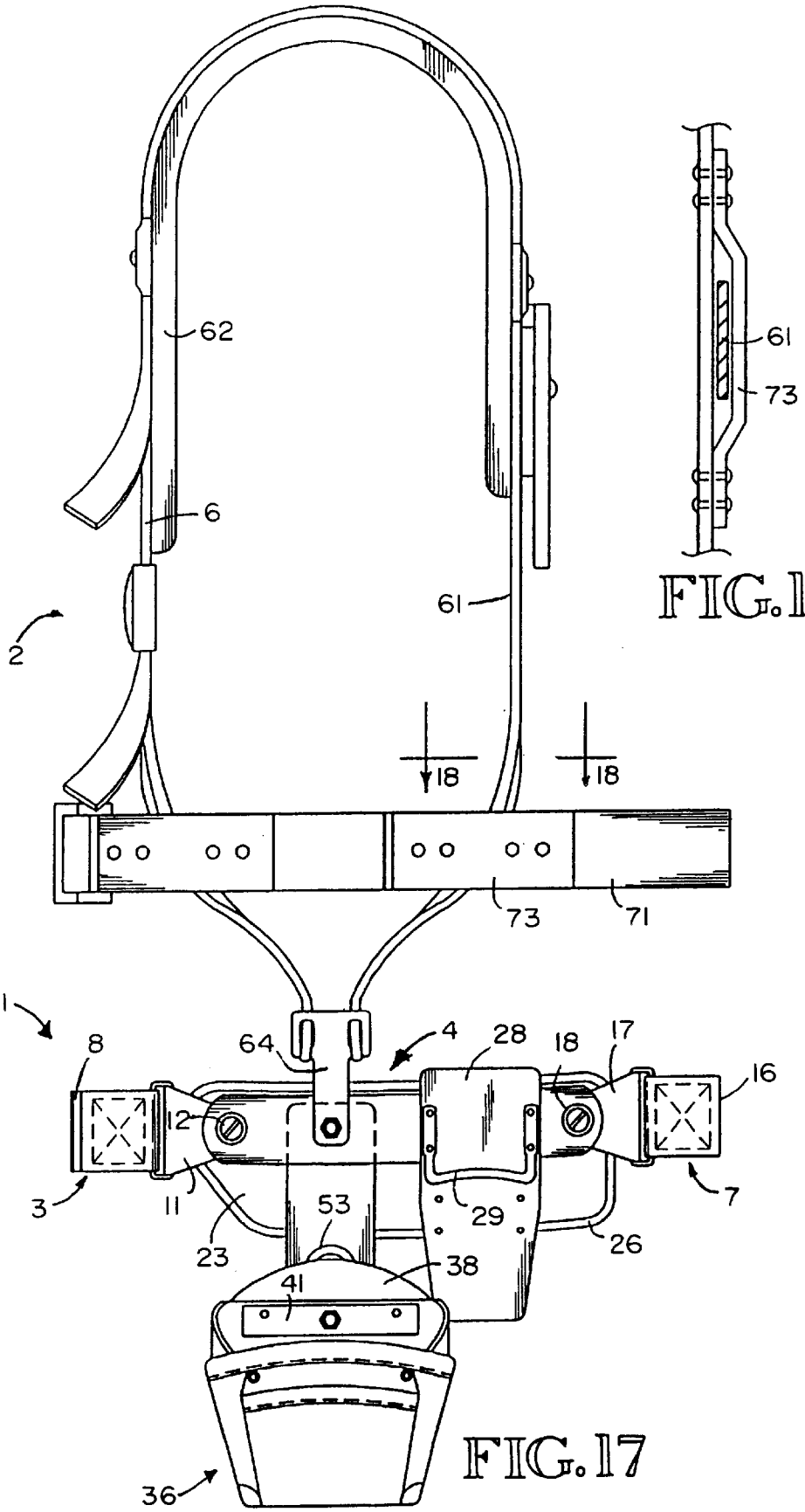
FIG. 17 is a side elevational view of the left hip section of the waist belt connected to the shoulder harness.
FIG. 18 is a cross sectional view taken along lines 18—18 of FIG. 17.
Figure 19:
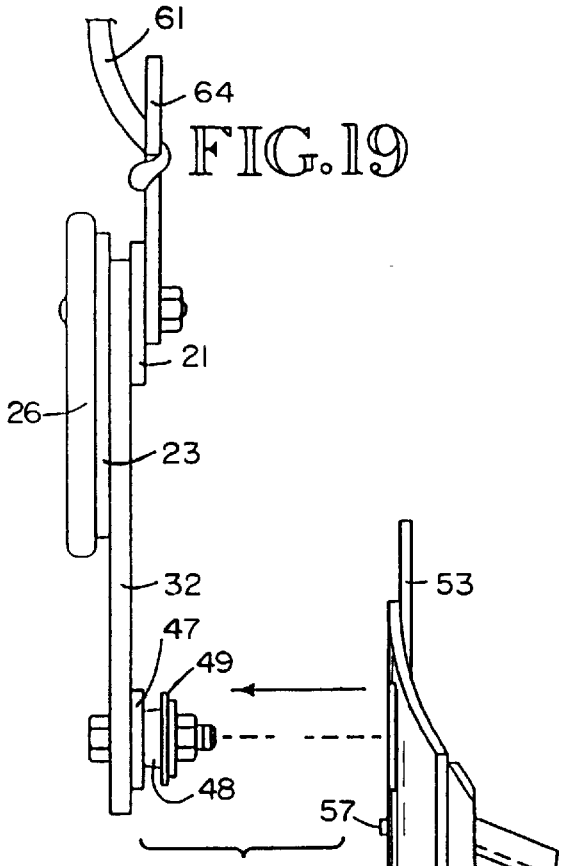
FIGS. 19–21 are side elevational views illustrating the steps in attaching the tool pouch to the support bracket.
Figure 20:
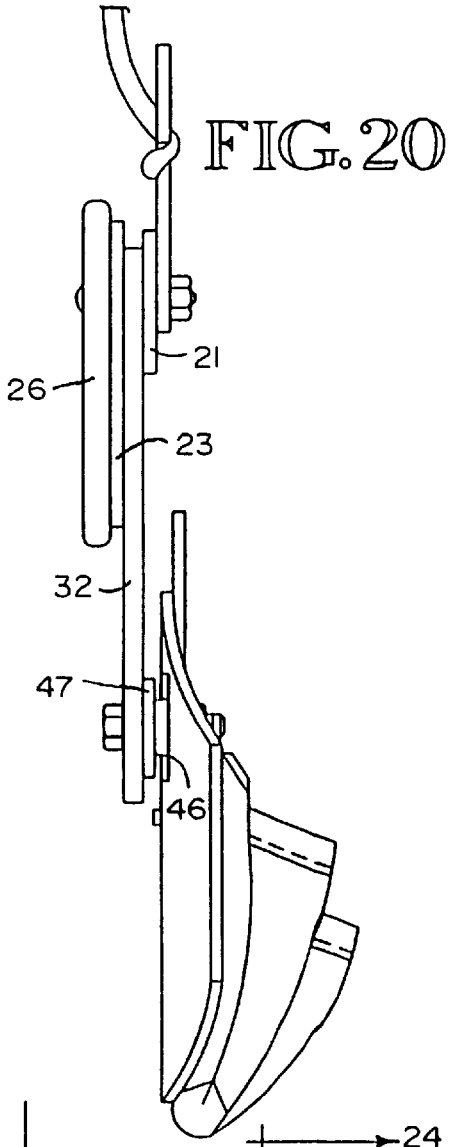
Figure 21:
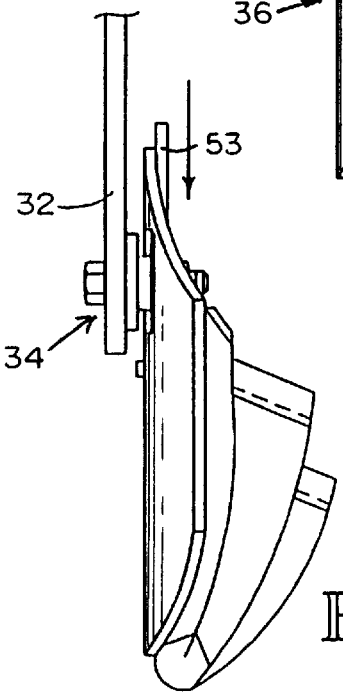
Figure 22:
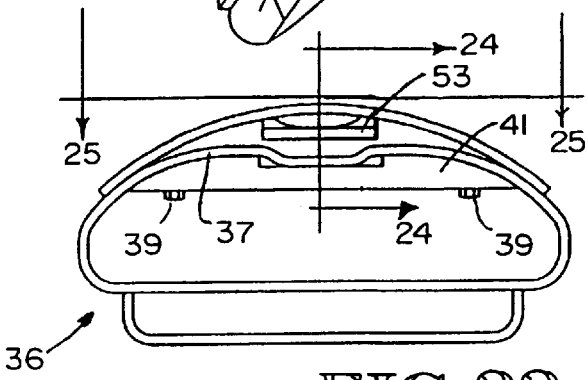
FIG. 22 is a top plan view of the tool pouch.

FIGS. 14 and 17 illustrate a shoulder harness suitable for providing additional support to the articulated belt. The harness includes identical shoulder straps 61 which extend over the wearer's shoulders in association with conventional shoulder padding 62. The shoulder straps 61 may be continuous or segmented and anchored to points on the shoulder pads 62 in any well known manner. Each shoulder strap 61 will be provided with conventional belt tighteners 65 to enable adjustment of the shoulder straps independently. Each shoulder strap 61 passes through a single pivot point on the associated hip section. As shown in FIG. 4, the shoulder straps 61 are trained through the spaced slots 63 on the pivotally mounted anchor tabs 64 pivotally connected to the bolts 33. As shown in FIG. 4, the anchor tabs 64 are allowed to freely pivot on the bolts 33 as the shoulder harness is adjusted. In order to maintain the shoulder pads and straps spaced, a shoulder blade spacer 66 is connected between the shoulder pads in the area of the user's shoulder blades. For additional flexibility, the shoulder blade spacer may be assembled from at least three pieces with the two identical side pieces 67 being pivotally connected to the center panel 68 by the pivot points 69. If desired, a pectoral belt 71 may be trained about the wearer's lower chest region for still greater stability. The belt 71 will, of course, include a releasable connector such as the conventional snap lock 72 and will be provided with retention members 73 on the belt surface for receiving the shoulder straps 61 as shown in FIG. 18.

From the foregoing it will be understood that the present invention provides significant improvements in load supporting waist belts for carrying a load at connecting points below the waist on each side of the wearer. The pivot points are located below the waist and in the general area where the thigh bone joins the hip of the wearer. In addition a positive lock and quick release slide bar structure is provided for releasing the load connectors for emergency or other reasons. The four piece articulated belt structure with individual side hip pieces provides for 100% contact with the user's hips and enables the belt to be fitted to any size waist or contour of hips. The hip pieces can thereby remain aligned with the wearer's hips while performing physical activity. Although the load support belt has been described in terms of the support of tools, tool pouches and the like, the function of the belt is not so limited and in fact is especially adapted to receive any character of loading through the lower pivot points as described.

It is to be understood that the foregoing description and accompanying drawings have been given by way of illustration and example. It is also to be understood that changes in form of the several parts, substitution of equivalent elements and arrangement of parts which will be readily apparent to one skilled in the art, are contemplated as within the scope of the present invention, which is limited only by the claims which follow:

What is claimed is:

1. A load supporting waist belt comprising in combination;

hip sections adapted to contact and conform to the contours of a wearer's hips, front and rear belt sections extending between said hip sections, at least one of said belt sections including length adjustment elements incorporated therein, and at least one of said belt sections including a releasable connector, and pivotal connectors connecting said hip sections and said belt sections to enable articulation of the hip and belt sections.

2. A load supporting waist belt comprising in combination;

first and second hip sections adapted to contact and conform to the contours of the hips of a wearer, said hip sections providing attachment means for attaching items to be supported by said belt, front and rear belt sections for extending across front and rear areas of a wearer's waist, said front and rear belt sections extending between said hip sections, at least one of said belt sections including length adjustment elements, and said front section including a releasable connector incorporated therein, and pivotal connectors connecting said front and rear belt sections with respective ends of each of said hip sections, said belt encircling the wearer's waist with said hip sections aligned and in full contact with the wearer's hips, whereby, said waist belt is articulated to accommodate body movement and adjustable to fit the wearer's waist and said hip sections may be independently adjustably positioned relative to said front and rear belt sections for full alignment with the wearer's hips.

3. The load supporting belt of claim 2 wherein each said hip sections comprise;

a hip strap pivotally connected at each end to said front and rear belt sections, said hip strap comprising a rigid support member adapted to receive load items, a hip piece coextensive with said hip strap and independently pivotally connected to said front and rear belt sections, and a cushion element connected to said hip piece for contacting the wearer's hips.

4. The load supporting belt of claim 3 wherein;

said hip piece is fabricated from a hard flexible material capable of being curved to conform approximately to the contour of the wearer's hips, said hip piece and cushion element being of substantial width for full contact with the wearer's hips.

5. The load supporting belt of claim 3 including a shoulder harness for auxiliary support of said belt, said shoulder harness including;

right and left shoulder straps for engaging the wearer's shoulders, an anchor tab pivotally connected to each said hip straps, each said shoulder strap extending from an associated anchor tab and over the wearer's shoulder providing a single load support point on each said hip strap.

6. The load supporting belt of claim 4 including a load attachment structure comprising;

a rigid bracket fixed to said hip piece and said hip strap and extending downwardly therefrom, said bracket having a bottom end, and a load attachment assembly adjacent the bottom end of said bracket at the wearer's approximate hip-thigh bone connection area.

7. The load supporting belt of claim 6 including;

a hand operated releasable locking mechanism for releasably attaching a load to said load attachment assembly.

8. The load attachment belt of claim 7 wherein said load attachment assembly comprises a substantially horizontal pivot post extending outwardly from said bracket, a loading device adapted to receive said pivot post, and a sliding lock bar on said loading device movable between a raised release position and a lowered lock position with the lock bar in engagement with said pivot post.

* * * * *